United States Patent [19]

Inglese

[11] Patent Number: 4,605,100

[45] Date of Patent: Aug. 12, 1986

[54] LADDER EXTENSION LOCK

[75] Inventor: Giulio S. Inglese, Granada Hills, Calif.

[73] Assignee: Uniprode, Granada Hills, Calif.

[21] Appl. No.: 770,971

[22] Filed: Aug. 30, 1985

[51] Int. Cl.[4] ..... E06C 7/06

[52] U.S. Cl. ..... 182/213; 182/211

[58] Field of Search ..... 182/209–213

[56] References Cited

U.S. PATENT DOCUMENTS

| | | | |
|---|---|---|---|
| 304,420 | 9/1884 | McDormand | 182/213 |
| 369,084 | 8/1887 | Smith | 182/213 |
| 613,848 | 11/1898 | Seagrave | 182/213 |
| 687,945 | 12/1901 | Waggoner | 182/213 |
| 750,504 | 1/1904 | Tiefel | 182/213 |
| 1,964,067 | 6/1934 | Leach | 182/213 |
| 2,210,803 | 8/1940 | Dunn | 182/213 |
| 2,310,441 | 2/1943 | Klum | 182/213 |
| 4,299,306 | 11/1981 | Hawkins | 182/210 |
| 4,364,451 | 12/1982 | Wright | 182/213 |

*Primary Examiner*—Reinaldo P. Machado

*Attorney, Agent, or Firm*—Albert O. Cota

[57] ABSTRACT

A ladder extension lock that serves as a back-up unit for an existing ladder lock system. The inventive lock releasably locks in place a section of a multiple section extension ladder. The lock is comprised of a control bar (20) planar with a rung on the fly section, having pivot pins (24) on each end. A pair of hooks (26) are attached to the pivot pins (24) and mounting blocks (28) are fastened to the side rails of the ladder and also the hooks (26). A pair of springs (37) are disposed between the bar (20) and the rung, urging the bar away from the rung. A pully (38), attached to a yoke (36), allows a halyard (46) to be engaged within a groove in the pulley (38). When an operator applies force upon the halyard (46), the bar (20) is forced upward rotating the hooks (26) to clear the rungs of the ladder while hoisting, and when pressure is quickly released, the hooks (26) rotate to their locking position and mate with the rung, creating a fail-safe mechanical lock between the rung and the side rails.

6 Claims, 9 Drawing Figures

LADDER EXTENSION LOCK

TECHNICAL FIELD

The present invention relates to ladders with extending sections in general, and more specifically to an improved ladder extension lock that releasably retains a section of an extension ladder in an elevated position.

BACKGROUND ART

Multiple-section extension ladders conventionally use a halyard, in combination with a pulley and a rung engaging lock, to raise and lock the extended section to the required height. Previously, many types of locks have been used in endeavoring to provide an effective means to hold the section in its extended position. These locks are normally effective. However, there have been incidents, especially in hurried emergency situations, where the lock has failed causing the extended section to slip and cause bodily harm.

A search of the prior art did not disclose any patents that read directly on the claims of the instant invention, however, the following U.S. patents were considered related:

| U.S. Pat. No. | Inventor | Issue Date |
|---|---|---|
| 4,299,306 | Hawkins | 10 November 1981 |
| 2,310,441 | Klum | 9 February 1943 |
| 2,210,803 | Dunn | 6 August 1940 |
| 1,964,067 | Leach et al | 26 June 1934 |
| 304,420 | Fox et al | 6 June 1884 |
| 750,504 | Tiefel | 13 May 1903 |
| 687,945 | Waggner | 18 March 1901 |
| 613,848 | Seagrave | 29 August 1898 |

Hawkins teaches a lock having a guideway arm attaching to two rungs simultaneously with a second member guiding the lock past the station of a ladder when the ladder is being extended or retracted.

Klum utilizes a lock having two triangular shaped members with an opening therethrough rigidly attached at their apexes to a rung, the ends of which are rotatably received in sockets secured to the legs of the ladder. A rope is attached over a sheave on a tie rod on one end and to the rung on the other, looping through a second sheave above the rung. The operator uses one portion of the looped rope to disengage the hook on the lock and the other end for hoisting.

Dunn practices a lock utilizing a bar formed into a loop around a rung with a hook on the opposite end. This bar is spring loaded and a cable is looped around a pulley for hoisting. In operation, tensioning the cable retracts the bar against the action of the spring allowing extension or retraction. To stop the ladder, the cable is released, suddenly extending the hook by spring pressure allowing the hooked end of the bar to be in contact with the next rung therebelow.

Leach et al employ a hook on the end of an arm that is connected to a rotatable rung. The rung also has a pulley attached to a bracket. When pressure is exerted on a rope throug the pulley, the angle of the arm is such that it pulls away from the rung upon which it is resting, allowing the ladder to be extended. When pressure is released, the hook is rotated inward by gravity locking into place on the next available rung.

Fox et al use a sheave disposed centrally on a rail over which a cord passes connected to an arm of a rock-shaft journaled on a rotatable shaft. A pair of upwardly projecting hooks are secured near the ends of the shaft and rotate as the rope is pulled disengaging the hooks when tension is applied. Release for retraction is accomplished in the reverse procedure.

For background purposes and as indicative of the art to which the invention relates reference may be made to the remaining cited patents.

DISCLOSURE OF THE INVENTION

Extension ladders per se have been in use for many years with prior art pertaining to improvements recorded for over a century. A common use for an extension ladder is for fire fighting, where human life is involved during an emergency situation and safety is of prime importance. Many ladders specifically designed for fire service have locks that maintain their extended position, however, field usage has proven that the actual function lacks reliability as numerous accidents have been caused directly related to the existing prior art. It is, therefore, the primary object of the invention to provide a highly reliable, safe, easy to operate lock for fire ladders, in particular, easily adaptable to existing apparatus in kit form, or as originally manufactured. The invention utilizes a pair of pivotal rung engaging hooks that move out of the way of the next rung when extended and spring loaded, in a positive manner, into a locked position when tension on a halyard is released. This feature allows the hook to be deadlocked in the engaged position, except when the ladder is being controlled by the halyard.

An important object of the invention provides failsafe operation of the lock. The normal operating procedure in extending a ladder is for one operator to stand at the base and hold the ladder while another person hoists the top section by the use of halyard, or rope, that is connected loopingly through a series of pulleys. If the lock malfunctions, the halyard breaks, or slips, in the operators hands, the upper section retracts at high velocity, as considerable weight is involved. This creates a dangerous situation for the operator, or if a hand or foot is positioned over a rung, the shear action of the falling section can cause dismemberment or serious injury. Recorded incidents and requests for correction are on file, such as petition file no. 187, State of California, Department of Industrial Relations Occupational Safety and Health Standards Board, dated 1 April 1985.

Another object of the invention locates the apparatus for mechanical operation below the rung, or station, out of the way of the user so as not to create any interference. This location is convenient in that the pulley is in the center leaving both sides open and clear, as the center is not utilized during the climbing process by the user of the ladder.

A further object of the invention allows existing ladders to be easily modified using a simple kit having the necessary components for the retrofit. This kit fits many different styles and manufacturers of two or three section fire ladders with only minor modification necessary to the ladder itself, thus increasing the utility. While existing ladders may be modified, original equipment for both fire ladders, and general purpose sectionalized ladders may equally well be accommodated using this invention.

These and other objects and advantages of the present invention will become apparent from the subsequent detailed description of the preferred embodiment and the claims taken in conjunction with the accompanying drawings.

BEST MODE FOR CARRYING OUT THE INVENTION

Figure 1:
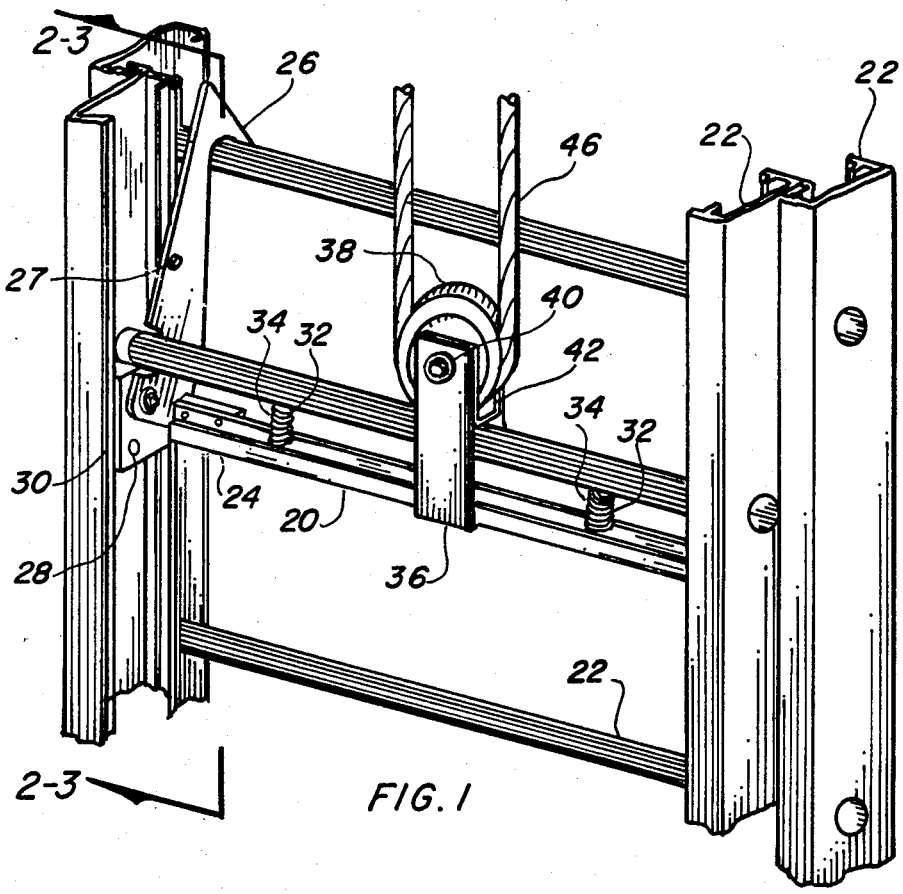
FIG. 1 is a partial isometric view of the preferred embodiment attached to an extension ladder.

The best mode for carrying out the invention is presented in terms of a preferred embodiment as shown in FIGS. 1 through 9. The ladder extension lock is comprised of a channel shaped control bar 20 that is movably positioned under a rung of a multiple-section extension ladder 22 as best shown in FIG. 1. This bar 20 is mitered or stepped at each end and is installed with the legs projecting upward toward the rung of the ladder 22. A pair of removable pivot pins 24 are attached on each end of the control bar 20 on the web, or on one of the upstanding legs, and extend outwardly. This pin 24 is flat on one end, where it attaches to the bar 20, and round on the other, becoming the pivot point for ultimate connection to the ladder 22. The pin 24 is normally attached to the bar 20 by a set of metal screws.

Figure 2:
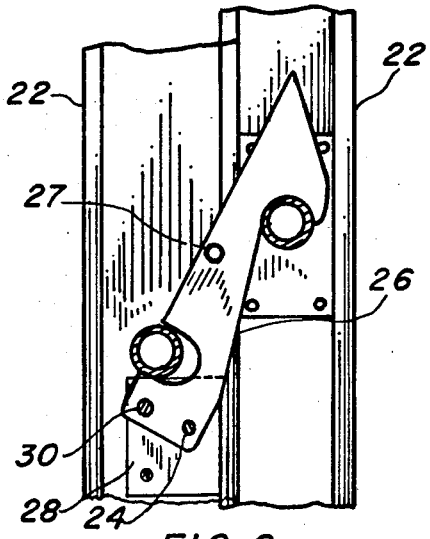
FIG. 2 is a cross-sectional view taken along lines 2—2 of FIG. 1.
Figure 3:
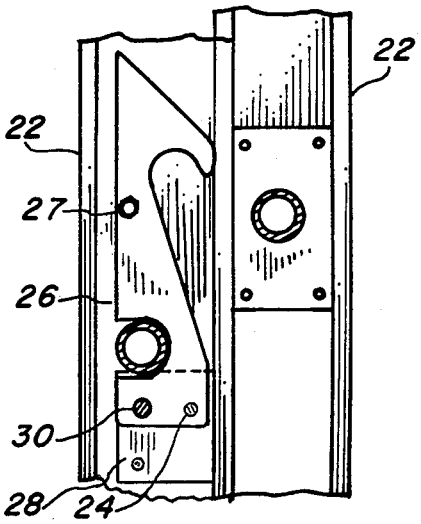
FIG. 3 is a cross-sectional view taken along lines 3—3 of showing the hook in the unlocked position.

A pair of rung engaging hooks 26 are rotatably connected to the pivot pins 24 through holes located within the hook. The hook 26 has a thickness sufficient to maintain structural integrity of the ladder section while resting thereupon, and also to withstand stress loads when released. The hole, therefore, has sufficient strength to function independently, or a bushing, such as an oil impregnated sintered bronze sleeve, may be added for further wear resistance. The hook 26 is fabricated of a flat metallic plate, preferably aluminum, steel, or magnesium, and is shaped with an angular top with a concave surface on one side, tapering to full width and a notch on the other side. This hook 26 is so shaped as to grip one rung of the ladder 22 on one side and clear another on the opposite side as best shown in FIG. 2. In operation this hook 26 axially rotates outwardly when the control bar is urged upward toward the ladder rung clearing the rung above, as best shown in FIG. 3. The angular top assists this movement when the ladder is extended manually without using the halyard. In this case, the hook 26 will ride over the rungs as the ladder is extended. A hook stop 27 is rigidly mounted on the side of each hook 26, creating an obstruction, preventing the hook from over-travelling in its pivotal arc during the operation of hoisting or lowering. This stop 27 consists of a hollow spacer in conjunction with a capscrew positioned within a threaded hole in the hook 26, or may be any mechanical structure, such as a roll pin, socket head capscrew, rivet, or the like.

Figure 4:
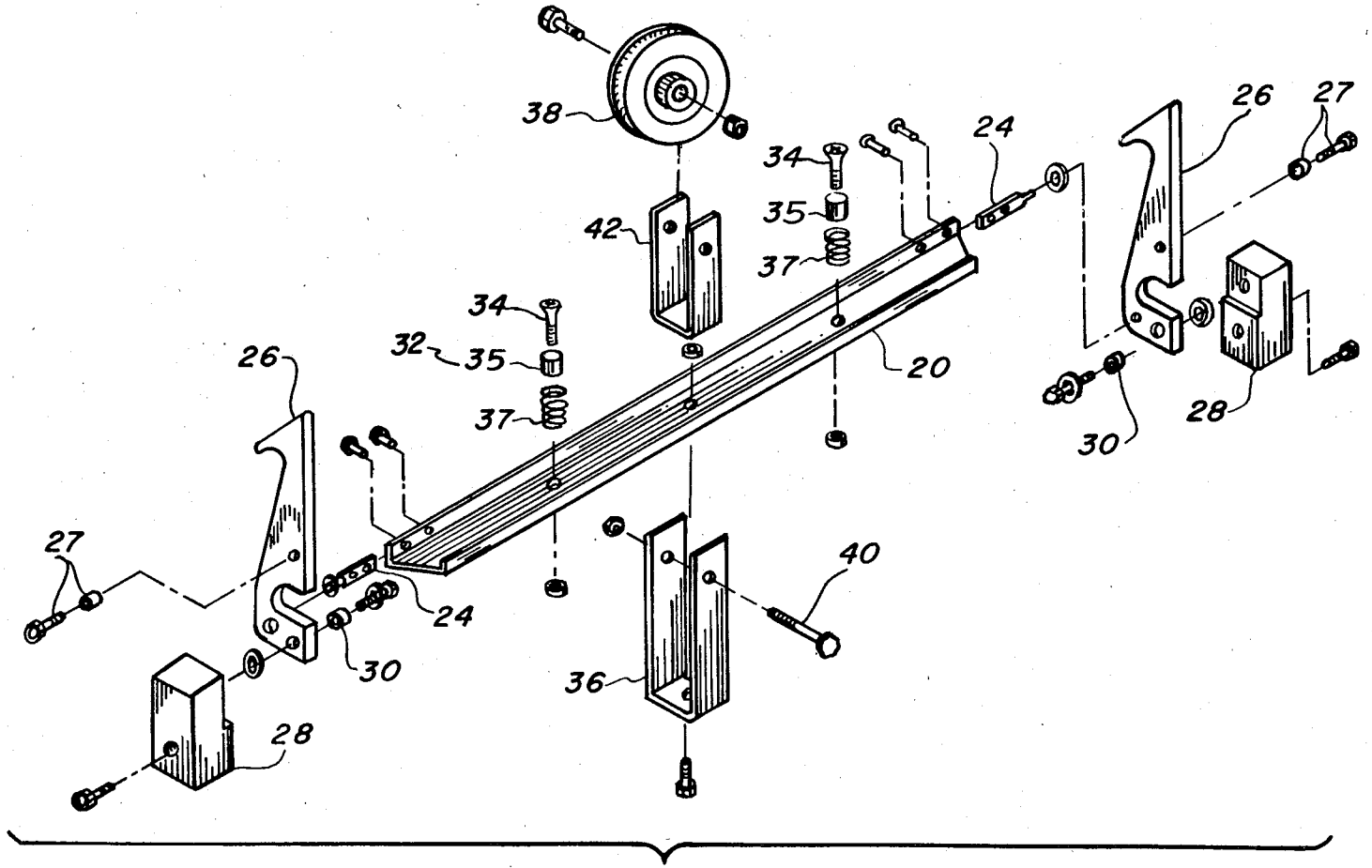
FIG. 4 is an exploded view of the preferred embodiment less the halyard and hoisting pulleys and is completely removed from the ladder.

A pair of mounting blocks 28, as best shown in FIGS. 1 and 4, are attached into the side rails of the ladder 22 immediately below a rung. These blocks 28 become a structural member to receive the hook 26 with swivel means in the form of a pivot capscrew with a bearing sleeve 30. The block 28 is internally threaded allowing attachment from the outside a similarly threaded hole is located on the inside receiving the capscrew and sleeve 30 for attachment of the hook 26. This screw and sleeve 30 provide the pivot point in conjunction with the control bar pivot pin 24, converting linear movement of the bar 20 to axial rotation of the hook 26 when the bar 20 is urged upward toward the rung of the ladder 22.

A plurality of adjustable control bar stops 32, preferably two, are attached to the inside of the web of the control bar 20. Each control bar stop 32 is comprised as best shown in FIG. 4, of a threaded fastener 34, such as a flathead bolt, containing a spring guide sleeve 35 and a compression spring 37. The bolt, in turn, is locked in place on the control bar 20 by means of a locknut 39. The spring 37 is compressibly fixed between the bar 20 and the rung of the ladder 22 directly above. This provides continual tension on the bar 20, driving it to the maximum spaced relationship while maintaining the hook 26 in its retracted position, due to its attachment through the pins 24.

This arrangement allows adjustment to be made between the rung and the bar 20 by rotating the stop 34 until the proper height is achieved. Once this height is reached, the stop 34 is locked in placed on the control bar as previsouly described.

Figure 6:
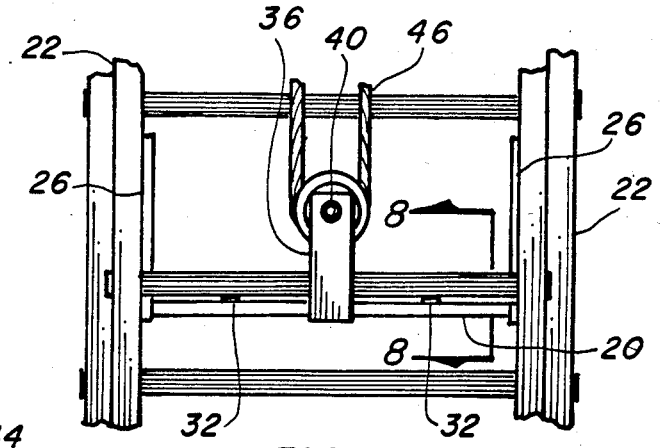
FIG. 6 is a front view of the preferred embodiment in the blocked position.
Figure 7:
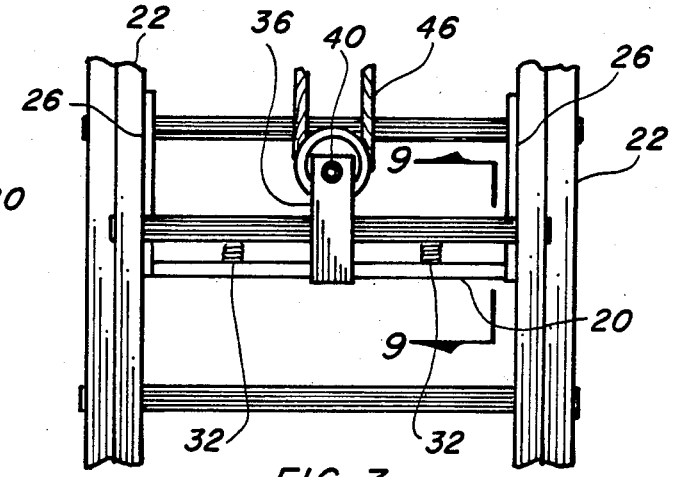
FIG. 7 is a front view of the preferred embodiment in the unlocked position.
Figure 8:
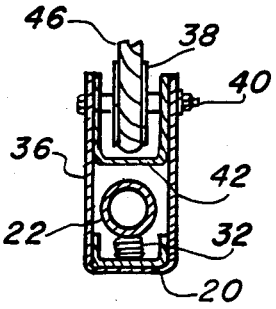
FIG. 8 is a cross-sectional view taken along lines 8—8 of FIG. 6 in the locked position.
Figure 9:
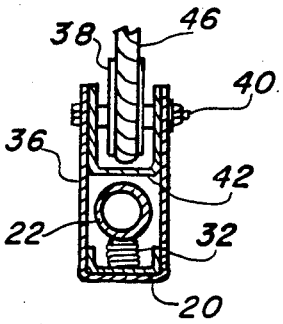
FIG. 9 is a cross-sectional view taken along lines 9—9 of FIG. 7 in the unlocked position.

A channel shaped pulley yoke 36, as best shown in FIGS. 4 and 8, is positioned under the web of the bar 20, in the middle, with the legs distended upward defining an attachment member. The legs of the yoke 36 are of sufficient length to extend beyond both the bar 20 and the rungs of the ladder 22. The yoke 36 is attached to the bar with fastening means, well known in the art, and a pulley 38, having an axle 40, is rotatably positioned between the legs of the yoke 36. This pulley 38 has a grooved rim and a set of centrally located bearings for rotation. The pulley axle 40 is comprised of a headed capscrew having a hexagonal or round head with solid shank, and a hexagonal headed lock nut threadably attached to the screw. A dowel pin with retaining rungs may also be used for the pulley axle 40, as an alternate embodiment. A channel shaped halyard guide 42 is disposed contiguously within the pulley yoke 36, separating the pulley 38 from the ladder rung. This structure allows a halyard to run freely within the groove of the pulley 38 wihout binding or interference. This arrangement is best illustrated in FIGS. 6, 7 and 8.

Figure 5:
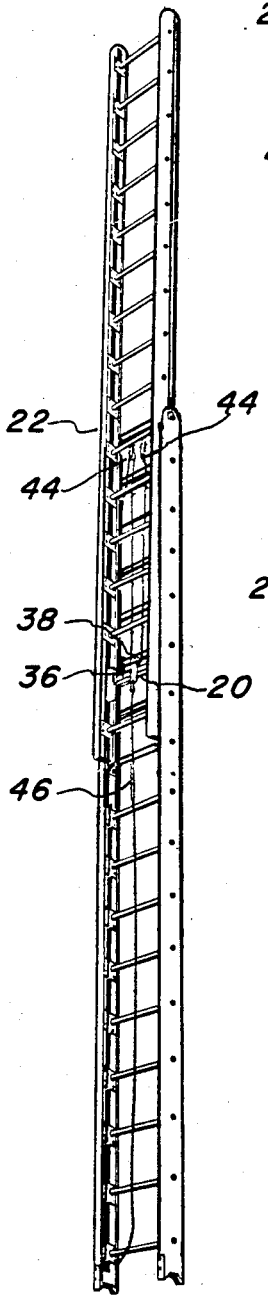
FIG. 5 is a partial isometric view of the preferred embodiment installed on a two section extension ladder.

A halyard 46, in the form of a rope, such as pure manilla, of sufficient size to raise the ladder sections, is threaded through the pulley 38 and alternately through the existing hoisting pulleys 44 with one end attached to the ladder section and the other end loose. This pulley arrangement allows an operator to hoist sections of a ladder 22 from the ground as shown in FIG. 5. The instant invention further includes the safety improvements such that when the section is hoisted by the halyard 46, in conjunction with the pulleys 38 and 44, the control bar 20 is urged upward toward a rung on the butt section against spring pressure, therefore, pivoting the hooks 26 outwardly away from the rungs on the fly section. This rotary movement allows the hooks 26 to pass by any number of rungs without interference while being hoisted or retracted. However, when tension is quickly released, even for a short distance, the hooks 26 will rotate to their locking position by the pressure of the springs 32. Thus, in the event of an accidental loosening grip on the halyard, breakage, or other unexpected release, the invention allows the ladder 22 to secure itself in the extended position, creating a fail-safe condition.

There are many arrangement of halyards and pulleys, depending upon the number of sections to be raised, the weight and orientation of the fly and butt sections, therefore, this prior art has little consequence to the invention, except that some arrangement is necessary to allow the halyard to be pulled from a position above the apparatus thus disclosed.

It will, therefore, be seen that the ladder extension lock serves as a fail-safe back-up unit to an existing ladder lock system affixed to a multiple section ladder.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the claims.

I claim:

1. A ladder extension lock for a sectionalized extendable ladder having channel side legs, and a plurality of rungs therebetween attached to interconnecting rung plates comprising:

(a) a channel shaped control bar movably positioned under one of the ladder rungs;

(b) a pair of pivot pins rigidly fastened on each end of said control bar distending outwardly therefrom for connection to said ladder;

(c) a pair of rung engaging hooks having swivel means, each rotatably contacting said pivot pin on one end and said ladder rung on the other, axially rotating when said control bar is urged upward toward said ladder rung;

(d) a pair of mounting blocks each nestingly joined within the inside of each ladder channel side leg defining a structural member receiving said hook swivel means rotatably attaching said hook to the ladder providing the hook with a pivot point in conjunction with said control bar pivot pin for converting linear movement of the bar to axial rotation of the hook when the bar is urged upward toward said ladder rung;

(e) a plurality of guide mounted compression springs abutted to said control bar and contiguous with one of the ladder rungs, drivingly urging the bar away from the rung;

(f) a channel shaped pulley yoke having a web and upstanding legs nestingly attached to said control bar abutting the web of the channel in the middle, defining an attachment member immediately above the rung of the ladder under which said bar is located;

(g) a pulley having an axle rotatably positioned between the legs of said yoke providing a sheave with a groove rim to change directions of a pulley force;

(h) a plurality of existing hoisting pulleys attached to the uppermost section of said ladder above said control bar for changing direction of a pulley force; and, (i) a halyard loopingly positioned around said pulley and hoisting pulleys with one end attached to the ladder and the other loose, allowing an operator to hoist sections of said extendable ladder, while doing so said control bar is urged upward toward said rung against spring pressure, pivoting said hooks outwardly away from the rungs allowing the hooks to pass by while being hoisted with said hooks being returned to their locking position, as urged by said springs, when the tension on said halyard is quickly released, thus creating a fail-safe condition in the event of an accidental loosening grip on said halyard.

2. The invention as recited in claim 1 further comprising: a pair of adjustable control bar stops attached to the inside web of said control bar when each of said stops comprises a threaded fastener containing a spring guide sleeve and said compression spring and where said stop is held in place on said control bar by a locking means and provides mechanical interference between said bar and said ladder rung in an adjustable manner to limit the travel of said bar.

3. The invention as recited in claim 1 wherein said rung engaging hook further comprises: a flat plate having an angular top with a concave surface on one side tapering to the full width, and a notch on the opposite side providing a structural member to grip one rung of said ladder on one side and clear another on the opposite side.

4. The invention as recited in claim 1 further comprising: a hook stop mounted upon the side of each hook, creating an obstruction, preventing the hook from overtravelling in its pivotal arc during its operational mode.

5. The invention as recited in claim 1 further comprising: a channel shaped halyard guide disposed contiguously within pulley yoke, separating said pulley from said ladder rung to allow said halyard to run freely within said pulley and hold the elements apart when held under the influence of said compression springs.

6. The invention as recited in claim 1 wherein said pulley axle further comprises: a headed capscrew with a solid shank, and a lock nut threadably attached to the end allowing rotation of said pulley and containment therein.

* * * * *